United States Patent [19]

Shy et al.

[11] 3,959,890

[45] June 1, 1976

[54] METHOD AND APPARATUS FOR ADJUSTABLY FEEDING RAW MATERIAL TO A PREHEATER FOR A KILN

[75] Inventors: James L. Shy, East Troy; Robert M. Bliemeister, Milwaukee, both of Wis.

[73] Assignee: Allis-Chalmers Corporation, Milwaukee, Wis.

[22] Filed: May 16, 1975

[21] Appl. No.: 578,363

[52] U.S. Cl. ..... 34/10; 34/57 R; 432/14; 432/17; 432/58

[51] Int. Cl.[2] ..... F26B 3/08; F27B 15/08

[58] Field of Search ..... 432/14, 15, 58, 17, 432/106; 34/10, 57 R

[56] References Cited

UNITED STATES PATENTS

| | | | |
|---|---|---|---|
| 2,520,717 | 8/1950 | Hagerbaumer | 432/17 |
| 2,883,173 | 4/1959 | Labouleis | 432/58 X |
| 3,578,296 | 5/1971 | Metz et al. | 34/57 R |
| 3,664,650 | 5/1972 | Weber et al. | 432/58 |
| 3,910,754 | 10/1975 | Weber et al. | 432/14 |
| 3,914,098 | 10/1975 | Kano et al. | 432/58 |

*Primary Examiner*—John J. Camby
*Attorney, Agent, or Firm*—Arthur M. Streich

[57] ABSTRACT

An apparatus is disclosed in which a raw material feed delivery pipe is connected to the periphery of a vertical conduit that receives gases from a rotary kiln and conducts such gases upwardly to a location where the gases are divided between a pair of cyclone gas-solids-separator heat exchangers comprising a first stage of raw material preheating. An axially movable and rotatable sleeve is mounted over the discharge end of the pipe, and the sleeve is provided with a terminal nozzle portion curved to discharge raw material at an obtuse included angle to the axis of the delivery pipe. A method is disclosed by which the sleeve is moved along the pipe and rotated relative to the pipe, to change the nozzle discharge location and deflection angle relative to the rising gas stream, until an equal temperature drop of gases in both heat exchangers is achieved and balanced loading thereof is thereby indicated.

5 Claims, 2 Drawing Figures

METHOD AND APPARATUS FOR ADJUSTABLY FEEDING RAW MATERIAL TO A PREHEATER FOR A KILN

BACKGROUND OF THE INVENTION

1. Field of the Invention

This invention relates to methods and apparatus for preheating particulate feed material for a rotary kiln with hot exit gases from the kiln, such as for the production of cement, and in particular, to the balanced feeding of raw materials to a first stage of preheating in a pair of cyclone type gas-to-solids heat exchangers.

2. Description of the Prior Art

Preheaters for kilns are known to the prior art that involve preheating finely divided raw materials suspended in and moving generally counter to the flow of heated kiln exit gases, and in which at least the first stage of preheating takes place in a pair of parallel devices such as cyclone dust-gas separators. Examples of such preheaters are disclosed in U.S. Pat. No. 2,663,560 of Dec. 22, 1953; U.S. Pat. No. 2,733,909 of Feb. 7, 1956; U.S. Pat. No. 2,785,886 of Mar. 19, 1957; U.S. Pat. No. 2,797,077 of June 25, 1957; U.S. Pat. No. 3,083,472 of Apr. 2, 1963; U.S. Pat. No. 3,102,719 of Sept. 3, 1963; U.S. Pat. No. 3,259,997 of July 12, 1966; and U.S. Pat. No. 3,288,450 of Nov. 29, 1966. Each of those patents discloses apparatus and operations in which raw material is fed from above the preheater, downwardly through a vertical pipe, into the center of a rising gas stream which divides and carries the material into a pair of parallel arranged cyclone type solids-gas separator heat exchangers. None of these patents disclose any means for adjusting the flow of material into the two parallel first stage preheating devices.

Sometimes, however, an arrangement of a plant is such that it is not convenient or desirable to feed the preheater from above. Raw material may then be fed to the outer periphery of a rising gas stream as shown in U.S. Pat. No. 3,726,045 of Apr. 10, 1973 and U.S. Pat. No. 3,752,455 of Aug. 14, 1973. This latter patent discloses an apparatus in which such peripheral fed material is carried in an upwardly moving gas stream and divided between a pair of parallelly arranged first stage preheating devices, without any way to adjust the distribution of feed material, and it has been our experience that such an apparatus is much more likely to operate with an unbalanced flow of material between the two devices of first stage preheating.

It is to this problem of an unbalanced distribution of raw material to a pair of first stage preheating heat exchangers that the present invention is directed, and to solve this problem is this invention's object.

SUMMARY OF THE INVENTION

According to a preferred embodiment of the present invention, a horizontal feed delivery pipe is connected to the periphery of a vertical conduit that receives hot gases discharged from a rotary kiln, and conduits such gases upwardly to a location where such gases are divided between a pair of cyclone gas-solids separator heat exchangers comprising the first stage of raw material preheating. An axially movable and rotatable sleeve is slidably mounted over the discharge end of the pipe to project into the gas conduit radially inward of the pipe. The sleeve is provided with a terminal nozzle portion within the gas conduit, curved to discharge the raw material therefrom at an obtuse included angle of preferably about 150° to the horizontal central axis of the pipe. The sleeve can thus be slid along and rotated relative to the feed delivery pipe to move the terminal nozzle portion relative to the centerline of the gas conduit and to adjust the angle of nozzle and the feed material passing therethrough relative to the rising gas stream in the gas conduit.

According to the method of the present invention, temperatures are measured at corresponding cyclone locations to determine material discharge or gas exhaust temperatures, and unequal temperatures or unequal temperature drops are taken as an indication that material flow to the two devices of the first preheat stage is not balanced. The sleeve is then moved axially along the feed delivery pipe and/or the sleeve rotated relative to the feed delivery pipe, until the two temperatures are equal, or have experienced equal temperature drops. When this desired condition is achieved, the sleeve is securely clamped to the pipe.

Other features and objects of the invention that have been attained will appear from the more detailed description to follow with reference to an embodiment of the present invention shown in the accompanying drawing.

DESCRIPTION OF THE PREFERRED EMBODIMENT

Figure 1:
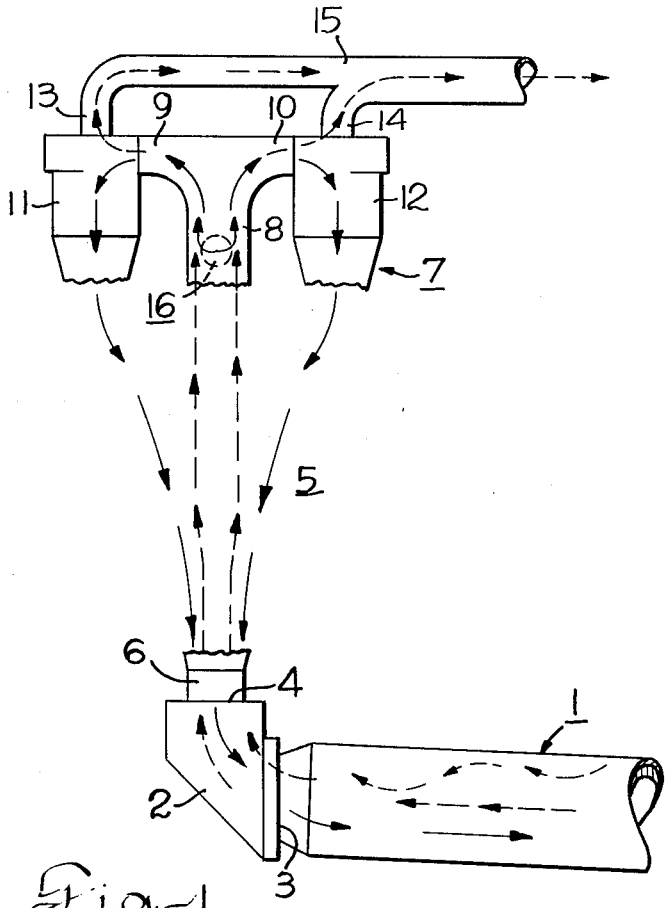
FIG. 1 of the accompanying drawing shows diagrammatically a side elevation of a rotary kiln feed material preheater to which the present invention can be applied.

With reference to FIG. 1, a rotary kiln 1 is provided with a hood 2 having an inlet opening 3 in a vertical plane around the end of the kiln 1. The hood 2 has a gas discharge opening 4. A particle suspension type preheater 5 is provided with a bottom portion 6 connected to the opening 4 of hood 2, and a top portion 7 vertically spaced above the bottom portion 6 by intermediate structure (not shown). Intermediate structure (not shown) between preheater portions 6 and 7 may be a cylindrical tower as shown in U.S. Pat. No. 3,441,258 or a plurality of cyclone separators as shown in U.S. Pat. No. 2,663,560, or a combination of a tower and cyclone separators as shown in U.S. Pat. No. 3,083,472 and U.S. Pat. No. 3,288,450.

The top portion 7 of the preheater 5 provides the first stage of raw material preheating and comprises a vertical gas conduit 8 for receiving kiln discharge gases that have passed through the intermediate structure (not shown) between portions 6 and 7 for what may be subsequent stages of preheat. The conduit 8 has a pair of gas discharge branches 9 and 10 that divide and deliver gas and entrained raw material (as will will appear from the description to follow) to a pair of cyclone heat exchangers 11 and 12. The gas enters each of the cyclone heat exchangers tangentially relative to a central vertical axis and hence is caused to rotate before leaving each exchanger through a central vertical discharge conduit 13, 14, respectively. The vertical conduits 13, 14 may be connected to a common header 15 for delivering the gases to devices (not shown) such as an electrostatic precipitator and an induced draft fan (as shown in U.S. Pat. No. 3,288,450) or gas permeable filter bags (as shown in FIG. 3 of U.S. Pat. No. 3,110,483). A raw material inlet assembly 16 is provided which injects raw material into the gas conduit 8.

Figure 2:
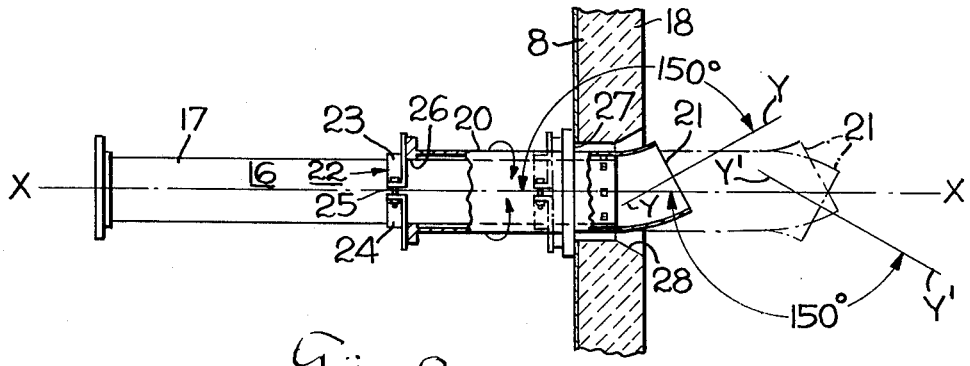
FIG. 2 shows an adjustable raw material feed pipe assembly, according to the present invention, for such as the preheater shown in FIG. 1.

Referring to FIG. 2, the material inlet assembly 16 is shown as comprising a raw material delivery pipe 17 which is arranged in a horizontal plane to project through the outer wall of conduit 8 and at least part way through refractory lining 18 applied to the inner wall surface of the vertical conduit 8. An axially movable and rotatable sleeve 20 is slidably mounted over the discharge end of the pipe 17 and projects into the gas conduit 8 radially inward of pipe 17 and lining 18. The sleeve 20 is provided with a terminal nozzle portion 21 which curves to direct the material discharged therethrough along an axis y—y angled away from an axis x—x central of pipe 17 to define an obtuse included angle between the axis x—x and the axis y—y of preferably about 150°. The sleeve 20 can, therefore, be slid along pipe 17 from the position shown in solid lines in FIG. 2 to the position shown in phantom lines, and rotated either clockwise or counterclockwise as indicated by arrows, to point nozzle 21 upwardly, such as along axis y—y, downwardly, such as along axis y′—y′, or any position therebetween. The sleeve 20 with its angled nozzle portion 21 is made secure in any selected position by a clamp 22. The clamp 22 may comprise a pair of semicircular half segments 23 and 24 with flanges for bolting the halves together at 25. Seals 26, 27 can be provided to prevent gases escaping from conduit 8. A portion of the refractory lining may be cut away as at 28 to provide space for the curved nozzle portion to rotate when sleeve 20 is in the fully retracted position.

In the operation of the described apparatus to produce such as Portland cement, raw materials are discharged through feed pipe 17, sleeve 20 and nozzle 21, into the rising stream of discharge gases from kiln 1. The gases with raw material entrained therein move upwardly in conduit 8 and divide to flow through gas discharge branches 9, 10 and tangentially into the cyclone preheaters 11 and 12, from which the gases pass upwardly through conduits 13, 14 to header 15. The raw material particles are meanwhile thrown outwardly against the inner wall surfaces of the cyclone heat exchangers 11, 12, and fall downwardly and out thereof to flow through such subsequent stages of preheating as may be provided before passing through hood 2 and into kiln 1.

In an operation according to the method of this invention, the temperature of gases passing through the conduit 8 will be substantially uniform across conduit 8 where raw materials are admitted through the device 16. Conduits 8, 9, 10 and exchangers 11 and 12 are symmetrical about a central axis through conduit 8 and unless there has been damage to conduits 8, 9 and 10, or an unsymmetrical accumulation of raw material from prior operation that has adhered to the inner surfaces thereof, the gas flow divides equally between the two cyclones 11, 12 and the temperatures in conduits 13, 14 should be substantially equal. Raw material is fed into the raw material delivery pipe 17 from such as a hopper or storage bin (not shown), and the sleeve 20 is moved axially and rotated so the stream of feed material is deflected at changing angles relative to the rising gas stream in conduit 8, until the temperature drop in both cyclones 11, 12, indicated by determining gas discharge temperatures in conduits 13, 14, is substantially equal. Equal gas temperatures in conduits 13, 14 indicate equal material loading in the two cyclones 11, 12 of the first stage of material preheating and the system is, therefore, operating in balance. With such balance having been achieved, the bolting at 25 may be tightened so that clamp 22 holds the movable sleeve in the selected adjusted position for such balanced operation.

From the foregoing detailed description of the present invention, it has been shown how the object of the present invention has been attained in a preferred manner. However, modification and equivalents of the disclosed concepts such as readily occur to those skilled in the art are intended to be included in the scope of this invention. Thus, the scope of the invention is intended to be limited only by the scope of the claims such as are or may hereafter be, appended hereto.

The embodiments of the invention in which an exclusive property or privilege is claimed are defined as follows:

1. A feed inlet assembly for feeding particulate raw material to a preheater for a rotary kiln or the like, with the preheater having a pair of gas-to-solids heat transfer devices for a first stage raw material preheating, and a gas supply conduit having a pair of gas discharge conduits therefrom for receiving gases from the kiln and conducting the gases upwardly and substantially equally to each of said first stage devices for preheating the raw material therein; said feed inlet assembly comprising:

a. a raw material delivery pipe adapted to be connected to a vertical sidewall portion of the gas supply conduit and open to the interior of the gas supply conduit;

b. a cylindrical sleeve mounted around the outer periphery of said pipe with said sleeve being slidable along and rotatable around said pipe; and c. said sleeve having a terminal nozzle portion adapted to project inwardly of the gas supply conduit and the raw material pipe, with said nozzle portion being curved away from an axis central to said pipe to direct material discharging through said nozzle along an axis which intersects the pipe central axis to define an obtuse included angle therebetween.

2. An apparatus for preheating particulate material for a rotary kiln or the like, with hot exit gases from the kiln, having a pair of gas-to-solids heat transfer devices for a first stage raw material preheating, a gas supply conduit with a pair of gas discharge conduits therefrom for receiving gases from the kiln and conducting the gases upwardly and dividing said gases to flow at substantially equal rates to each of said first stage devices, and a raw material feed inlet assembly for injecting particulate raw material into said gas supply conduit, said inlet assembly comprising:

a. a raw material delivery pipe connected to a vertical sidewall portion of the gas supply conduit and open to the interior of the gas supply conduit;

b. a cylindrical sleeve mounted around the outer periphery of said pipe with said sleeve being slidable along and rotatable around said pipe; and c. said sleeve having a terminal nozzle portion projecting inwardly of the gas supply conduit and the raw material pipe, with said nozzle portion being curved away from an axis central to said pipe to direct material discharging through said nozzle along an axis which intersects the pipe central axis to define an obtuse included angle therebetween.

3. An apparatus according to claim 2 in which the material delivery pipe is aligned in a substantially horizontal position and connected to the gas supply conduit at an angle of approximately 90°, and the included angle between pipe central axis and the axis of discharge from the curved nozzle portion is approximately 150°.

4. A method for feeding particulate raw material to a preheater for a rotary kiln or the like, with the preheater having a pair of gas-to-solids heat transfer devices for a first stage raw material preheating, and a gas supply conduit having a pair of gas discharge conduits therefrom for receiving gases from the kiln and conducting the gases upwardly and substantially equally to each of said first stage devices for preheating the raw material therein; said method comprising:

a. injecting a stream of raw material into the gas supply conduit along an entry axis transverse to a central axis of the supply conduit;

b. deflecting the stream of raw material within the supply conduit, along a second axis which intersects the entry axis to define an obtuse included angle; and c. moving the intersection of the entry axis and the second axis along the entry axis and rotating the deflected portion of the stream around the entry axis until the temperature drop of gases passing through each of the heat transfer devices becomes substantially equal, to thereby operate the preheater with substantially balanced loading of raw material between the pair of heat transfer devices.

5. A method according to claim 4 in which the stream of raw material is injected into the supply conduit along an axis substantially perpendicular to the central axis of the supply conduit, and the stream is deflected to define an included angle between the entry axis and the second axis of approximately 150°.

* * * * *